United States Patent [19]

Shon

[11] Patent Number: 4,978,821

[45] Date of Patent: Dec. 18, 1990

[54] REVERSE FLOW PREVENTION DEVICE FOR COMBUSTION APPARATUS

[75] Inventor: Jin-Ki Shon, Suwon, Rep. of Korea

[73] Assignee: Samsung Electronics Co. Ltd., Rep. of Korea

[21] Appl. No.: 442,204

[22] Filed: Dec. 1, 1989

[30] Foreign Application Priority Data

Dec. 26, 1988 [KR] Rep. of Korea ..... 88-17487

[51] Int. Cl.[5] ..... H01H 35/40

[52] U.S. Cl. ..... 200/83 W; 200/83 N; 126/307 A; 431/16; 431/19

[58] Field of Search ..... 431/16, 19, 20; 200/83 W, 83 N; 126/307 A

[56] References Cited

U.S. PATENT DOCUMENTS 1,231,561 7/1917 Briggs ..... 200/83 W
2,069,222 2/1937 Cremer ..... 200/83 H
3,042,769 7/1962 Camnpbell ..... 431/20
4,613,297 9/1986 Zahias et al. ..... 431/16

*Primary Examiner*—Carroll B. Dority
*Attorney, Agent, or Firm*—Saidman, Sterne, Kessler & Goldstein

[57] ABSTRACT

A reverse flow prevention device for combustion apparatuses control operated by electrical power, and which is provided with a combustion gas discharge tube for discharging the combustion process by-product. The reverse flow device comprising a reverse flow gas collecting tube installed within the combustion gas discharge tube for collecting reverse flow gas. The reverse flow device also comprises a detection means, with a function of detecting a reverse flow gas and turning OFF the combustion apparatus when the pressure of the reverse flow gas acting on the detection means is above a certain level.

5 Claims, 1 Drawing Sheet

REVERSE FLOW PREVENTION DEVICE FOR COMBUSTION APPARATUS

BACKGROUND OF THE INVENTION

1. Field of the Invention

The present invention relates to a reverse flow prevention device for combustion apparatus, which is installed in the combustion gas discharge tube in such a manner that if a reverse flow occurs within the discharge tube creating a pressure in excess of a predetermined level, the reverse flow prevention device operates to switch off the combustion apparatus before the reverse flow adversely affects the combustion apparatus and processes.

2. Related Art

Generally, combustion apparatuses such as gas boilers, oil boilers, briquet boilers, and the like are installed in such a manner that the main body or firing chamber of the combustion apparatus is disposed in one room. In the case of residential houses, for example, that room is typically the basement. In addition to the main chamber, a combustion gas discharge tube is provided so as to discharge the byproducts of the combustion process to the outside environment.

A strong wind, however, can cause the combustion gas flow to reverse directions through the combustion gas discharge tube and into the combustion apparatus. Moreover, outside air is combined with discharged gas and introduced to the combustion apparatus.

Reverse flow causes incomplete combustion. Further, if the reverse flow phenomenon is severe, the reverse flow gas can be introduced into the room to pollute the room air and to give a toxic effect to human bodies. Furthermore, such a severe reverse flow could potentially cause a fire. However, in the conventional apparatuses, no device exists to prevent such a reverse flow phenomenon.

SUMMARY OF THE INVENTION

The present invention is intended to overcome the above described disadvantages of the conventional combustion apparatus. The present invention is a reverse flow prevention device for combustion apparatuses, which can detect reverse flows. Upon detecting a reverse flow in excess of a certain predetermined level, the present invention operates to switch-off the combustion apparatus, so that adverse and disastrous results can be prevented.

BRIEF DESCRIPTION OF THE DRAWINGS

The above object and other advantages of the present invention should become apparent by describing the preferred embodiment of the present invention with reference to the accompanying drawings in which.

DESCRIPTION OF THE PREFERRED EMBODIMENT

Figure 1:
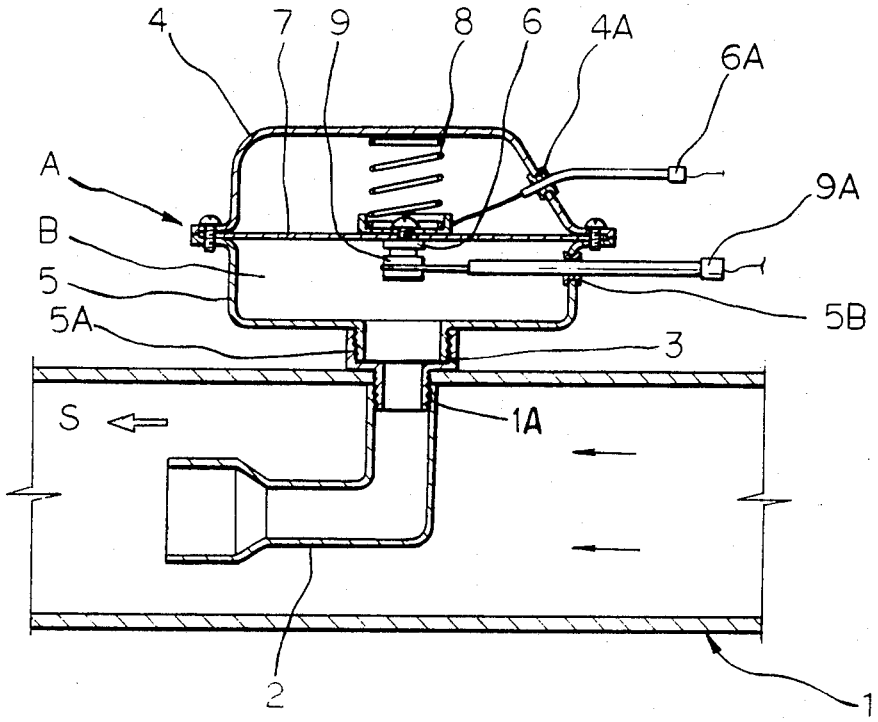
FIG. 1 is a sectional view of the assembled device according to the present invention showing a normal operating state.

FIG. 1 illustrates a combustion gas discharge tube 1 for a combustion apparatus (not shown) which operates by the use of electric power. The device according to the present invention comprises: a reverse flow gas collecting tube 2 installed within the combustion gas discharge tube 1 near the leading end of the combustion gas discharge tube 1 in order to receive any reverse flow gas flowing through the discharge tube 1; and a detection means A installed externally to the discharge tube 1, and connected to the reverse flow gas collecting tube 2. The detection means A has the function of switching-off the combustion apparatus upon detection of a reverse flow pressure in excess of a certain predetermined level. In this embodiment, the electric power applied to the combustion apparatus can be automatically controlled due to the function of detection means A.

The device of the present invention thus constituted will be further described below in more detail.

An assembling hole IA is provided at the side of the leading end of the discharge tube 1. A connecting member 3 having threadable fasteners is inserted through the assembling hole 1A into the discharge tube in such a manner that the threadable fastenings are accessible inside and outside of the combustion discharge tube 1. The reverse flow gas collecting tube 2 is coupled with the downwardly projected portion of the connecting member 3.

The detection means A is then fitted to the upwardly projected portion of connecting member 3.

The detection means A having the above described function comprises an upper housing 4 and a lower housing 5 which form a pressure vessel B; a diaphragm 7 installed within the pressure vessel B, having sufficient flexibility to bend up and down depending on the pressure of the reverse flow gas; an elastic member 8 installed in the vertical direction between the upper housing 4 and the diaphragm 7 centrally to the diaphragm 7, which can contract or expand depending on the up and down movements of the diaphragm 7; a movable contact 6 connected to an external power source terminal 6A, that moves up and down along with the diaphragm 7; and a fixed contact 9 rigidly connected to an operational terminal 9A extended out from the interior of the combustion apparatus.

Meanwhile, the upper housing 4 and the lower housing 5 are provided with a supporting member 4A and a retaining member 5B respectively at certain positions thereof in such a manner that the power source terminal 6A and the operational terminal 9A can respectively pass through them. The bottom of the lower housing 5 is provided with a coupler 5A that fastens to the upper portion of the connecting member 3.

The device of the present invention constituted as above will now be described as to its action and effect.

The device according to the present invention is applicable to a combustion apparatus which can perform combustion operations by application of electric power, and is provided with a combustion gas discharge tube for discharging the combustion gas outside of the room. FIG. 1 illustrates a state in which the combustion gas is smoothly discharged in the direction of arrow S. A strong outside wind, however, may reverse the flow direction of the combustion gas from the normal direction as indicated by Arrow S, to the opposite direction indicated by arrow N. Accordingly, the reverse flow gas is collected into the reverse flow gas collection tube 2. The collected gas is then introduced through the internal passage into the pressure vessel B of the lower housing 5.

If the combustion gas flow is discharged in the normal direction (without occurrence of a reverse flow), the movable contact 6 attached to the diaphragm 7 is kept in contact with the fixed contact 9. Fixed contact 9 is positioned directly under the movable contact 6. Movable contact 6 is electrically connected to the line leading to the interior of the combustion apparatus, thereby maintaining the power to the combustion apparatus.

Figure 2:
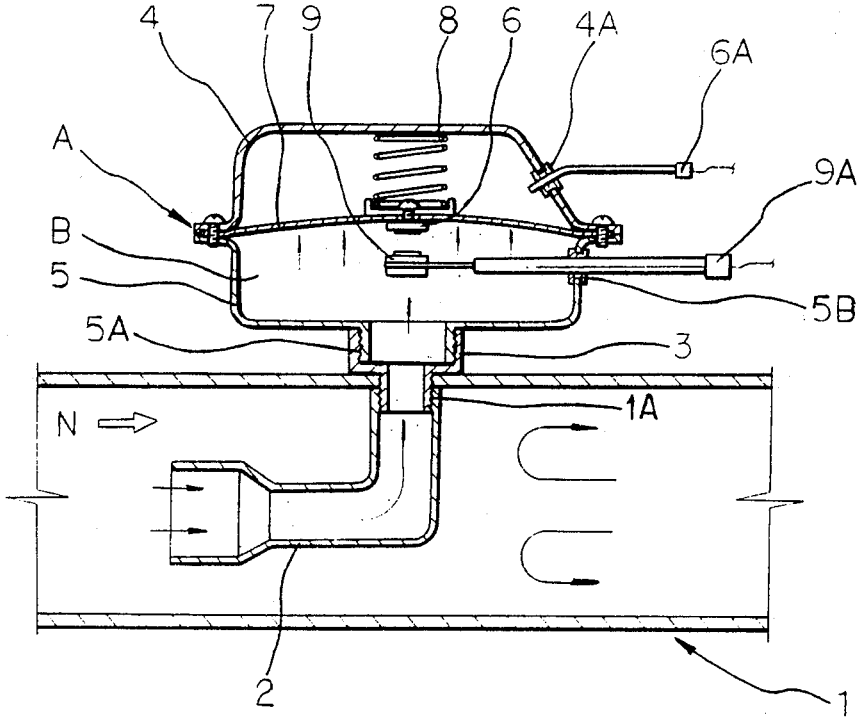
FIG. 2 is a sectional view of the assembled device according to the present invention showing an operating state upon occurrence of a reverse flow.

On the other hand, if the gas flow direction is reversed in the direction indicated by Arrow N, the reverse flow gas introduced into the reverse flow collection tube 2 is transferred to the pressure vessel B of the lower housing 5 applying pressure to the diaphragm 7. Then, the elastic member or spring 8 which is installed between the upper housing 4 and the movable contact 6 of the diaphragm 7 is compressed, thereby moving the movable contact 6 upwardly as shown in FIG. 2. Accordingly, the contact between the movable contact 6 and the fixed contact 9 is disengaged, causing the electrical connection between the power source terminal 6A and the operational terminal 9A to be opened. Therefore, the operation of the combustion apparatus is stopped.

In short, if an abnormal reverse flow of combustion gas occurs in the direction indicated by Arrow N, within the discharge tube 1, the reverse flowing gas collected in the reverse flow gas collection tube 2 is transferred to the pressure vessel B of the detection means A. The pressure of the gas introduced into the pressure vessel B acts on the diaphragm 7 causing the movable contact 6 to separate from the fixed contact 9. The power source is thereby disconnected from the combustion apparatus. Meanwhile, if the circumstances which caused the reverse flow are withdrawn, the pressure within the pressure vessel B is dissipated. Accordingly, the movable contact 6 of the diaphragm 7 returns to the fixed contact 9 due to the elastic force of the elastic member 8. The electrical connection between the power source terminal 6A and the operational terminal 9A is thereby reinstituted. Therefore, the combustion apparatus resumes normal combustion operation as shown in FIG. 1.

As described above, the device of the present invention is applied to a combustion gas discharge tube of a combustion apparatus. Reverse flows in the discharge tube activate a detection means so that the operation of the combustion apparatus can be stopped. Accordingly, the applicant's invention prevents introduction of toxic gases, incomplete combustions, and occurrence of fire accidents.

While a preferred embodiment has been set forth, various modifications, alterations, and changes may be made without departing from the spirit and scope of the present invention as defined in the appended claims.

What is claimed is:

1. A reverse flow prevention device for a combustion apparatus which is operated by electrical power, and which is provided with a combustion gas discharge tube for discharging the combustion process byproducts, which device comprises:

(a) a reverse flow gas collecting tube installed within said combustion gas discharge tube and open in a direction opposite normal flow of by-products through said gas discharge tube for collecting reversely flowing gas; and (b) a detection means coupled with said reverse flow gas collecting tube for turning OFF the combustion apparatus and stopping the combustion process when the pressure of the reverse flow gas acting on the detection means is above a certain level.

2. The reverse flow prevention device as claimed in claim 1, wherein said detection means comprises a pressure vessel, said pressure vessel comprising a diaphragm.

3. The reverse flow prevention device as claimed in claim 2, wherein said reverse flow gas collecting tube is threadably fastened to the lower portion of a member which is inserted into said combustion gas discharge tube.

4. The reverse flow prevention device as claimed in claim 3, wherein said detection means further comprises an elastic member installed between said upper housing and said diaphragm.

5. The reverse flow prevention device as claimed in claim 4, wherein said detection means further comprises a movable contact installed at the center of the diaphragm coupled with a power source terminal; and a fixed contact connected to an operational terminal.

* * * * *